US010841675B2

(12) United States Patent
Howard et al.

(10) Patent No.: US 10,841,675 B2
(45) Date of Patent: Nov. 17, 2020

(54) LOUDSPEAKERS AND RELATED COMPONENTS AND METHODS

(71) Applicant: Bose Corporation, Framingham, MA (US)

(72) Inventors: Raymond Thomas Howard, Franklin, MA (US); Michaela Freed, Watertown, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/217,193

(22) Filed: Dec. 12, 2018

(65) Prior Publication Data

US 2020/0196037 A1 Jun. 18, 2020

(51) Int. Cl.
*H04R 1/02* (2006.01)
*H04R 1/44* (2006.01)

(52) U.S. Cl.
CPC ..... *H04R 1/023* (2013.01); *H04R 1/025* (2013.01); *H04R 1/44* (2013.01)

(58) Field of Classification Search
CPC ..... H04R 1/023
USPC ..... 381/391
See application file for complete search history.

(56) References Cited

U.S. PATENT DOCUMENTS 3,938,618 A * 2/1976 Ambruoso, Sr. ..... H04R 1/023 181/155
4,974,698 A * 12/1990 Smith ..... H04R 1/023 181/150
5,113,968 A * 5/1992 Lemmon ..... H04R 1/023 181/148
5,412,162 A * 5/1995 Kindel ..... H04R 1/023 181/150
6,056,083 A * 5/2000 Daniell ..... H04R 5/02 181/144
6,993,145 B2 * 1/2006 Combest ..... H04R 1/023 181/199
7,346,181 B2 * 3/2008 Rivera ..... H04R 1/023 381/391
7,760,900 B2 * 7/2010 Kemmerer ..... H04R 1/023 381/386
8,112,130 B2 * 2/2012 Mittleman ..... H04M 1/035 455/575.1
8,437,493 B2 * 5/2013 Nho ..... H04M 1/035 381/386
8,488,817 B2 * 7/2013 Mittleman ..... H04M 1/035 381/189

(Continued)

FOREIGN PATENT DOCUMENTS

DE 2404943 A1 * 8/1975 ..... H04R 1/222
JP 11004493 A * 1/1999
KR 20100050856 A * 5/2010

*Primary Examiner* — Fan S Tsang
*Assistant Examiner* — Ryan Robinson
(74) *Attorney, Agent, or Firm* — Bose Corporation

(57) ABSTRACT

A loudspeaker includes an acoustic enclosure, and an electro-acoustic transducer that is supported by the acoustic enclosure. A grille covers the electro-acoustic transducer, and a weather-resistant member is disposed between the acoustic enclosure and the grille. A spring member is disposed between the weather-resistant member and the acoustic enclosure. The spring member is configured to apply a force to the weather-resistant layer thereby to hold the weather-resistant member against the grille.

25 Claims, 4 Drawing Sheets

(56) References Cited

U.S. PATENT DOCUMENTS

| | | | | |
|---|---|---|---|---|
| 9,014,411 | B2 * | 4/2015 | Rodgers | H04R 1/023 381/391 |
| 9,414,141 | B2 * | 8/2016 | Cohen | H04M 1/03 |
| 9,538,272 | B2 * | 1/2017 | Auclair | G10K 11/18 |
| 9,820,033 | B2 * | 11/2017 | Dix | H04R 1/2826 |
| 10,132,004 | B2 * | 11/2018 | Lee | H04R 1/023 |
| 10,356,497 | B1 * | 7/2019 | Brown | H04R 1/023 |
| 2002/0054978 | A1 * | 5/2002 | Holmberg | H04R 1/023 428/99 |
| 2015/0172798 | A1 * | 6/2015 | Chao | H04R 1/023 381/334 |
| 2017/0230739 | A1 * | 8/2017 | Soofer | H04R 1/025 |

* cited by examiner

LOUDSPEAKERS AND RELATED COMPONENTS AND METHODS

BACKGROUND

This disclosure relates to a loudspeaker, and, more particularly, to a loudspeaker having a weather-resistant grille assembly.

SUMMARY

All examples and features mentioned below can be combined in any technically possible way.

In one aspect, a loudspeaker includes an acoustic enclosure, and an electro-acoustic transducer that is supported by the acoustic enclosure. A grille covers the electro-acoustic transducer, and a weather-resistant member is disposed between the acoustic enclosure and the grille. A spring member is disposed between the weather-resistant member and the acoustic enclosure. The spring member is configured to apply a force to the weather-resistant layer thereby to hold the weather-resistant member against the grille.

Implementations may include one of the following features, or any combination thereof.

In some implementations, the weather-resistant member includes a scrim layer. The scrim layer may be formed of an acoustically transparent sheet form foam material.

In certain implementations, the spring member includes a substantially arcuate main body that extends between a par of opposing sidewalls.

In some examples, the substantially arcuate main body is biased outwardly, away from the acoustic enclosure, such that a concave side of the main body faces toward the housing.

In certain examples, the arcuate main body includes a plurality of cross-members.

In some cases, the cross-members extend diagonally relative to the sidewalls.

In certain cases, the cross-members intersect with each other at nodes.

In some implementations, the cross-members are arranged to form a notch to accommodate the geometry of the electro-acoustic transducer.

In certain implementations, the weather-resistant layer includes a screen layer disposed between the spring member and the scrim layer. The spring member may be configured to apply a force to the screen layer to hold a front surface of the screen layer against a rear surface of the scrim layer and to hold a front surface of the scrim layer against a rear surface of the grille.

In some examples, the weather-resistant member consists of a screen layer.

In certain examples, the screen layer includes an acoustically transparent sheet form material formed of a woven fabric. The woven fabric may be formed of metal filaments. In some cases, the screen layer may be formed of cloth.

Another aspect provides a grille assembly for a loudspeaker. The grille assembly includes a grille, a spring member, and a weather-resistant member disposed between the spring member and the grille. The spring member is configured to apply a force between an acoustic enclosure of a loudspeaker and the weather-resistant layer to hold a front surface of the weather-resistant member substantially flush against a rear surface of the grille.

Implementations may include one of the above and/or below features, or any combination thereof.

In some implementations, the weather-resistant member includes a scrim layer.

In certain implementations, the scrim layer is formed of an acoustically transparent sheet form foam material.

In some examples, the spring member includes a substantially arcuate main body that extends between a par of opposing sidewalls.

In certain examples, the sidewalls terminate at a pair of feet, which are arranged to rest against a surface of an acoustic enclosure of a loudspeaker.

In some cases, the substantially arcuate main body is biased outwardly, away from the acoustic enclosure, such that a concave side of the main body faces toward the housing.

In certain cases, the arcuate main body includes a plurality of cross-members.

In some implementations, the cross-members extend diagonally relative to the sidewalls.

In certain implementations, the cross-members intersect with each other at nodes.

In some examples, the cross-members are arranged to form a notch to accommodate the geometry of an electro-acoustic transducer of the loudspeaker.

In certain examples, the weather-resistant layer includes a screen layer disposed between the spring member and the scrim layer. The spring member may be configured to apply a force to the screen layer to hold a front surface of the screen layer against a rear surface of the scrim layer and to hold a front surface of the scrim layer against a rear surface of the grille.

In some cases, the weather-resistant member consists of a screen layer.

In certain cases, the screen layer comprises an acoustically transparent sheet form material formed of a woven fabric of metal filaments.

DETAILED DESCRIPTION

This disclosure is based, at least in part, on the realization that it can be beneficial to provide structural support to a scrim backing layer in a weather-resistant loudspeaker.

Figure 1A:
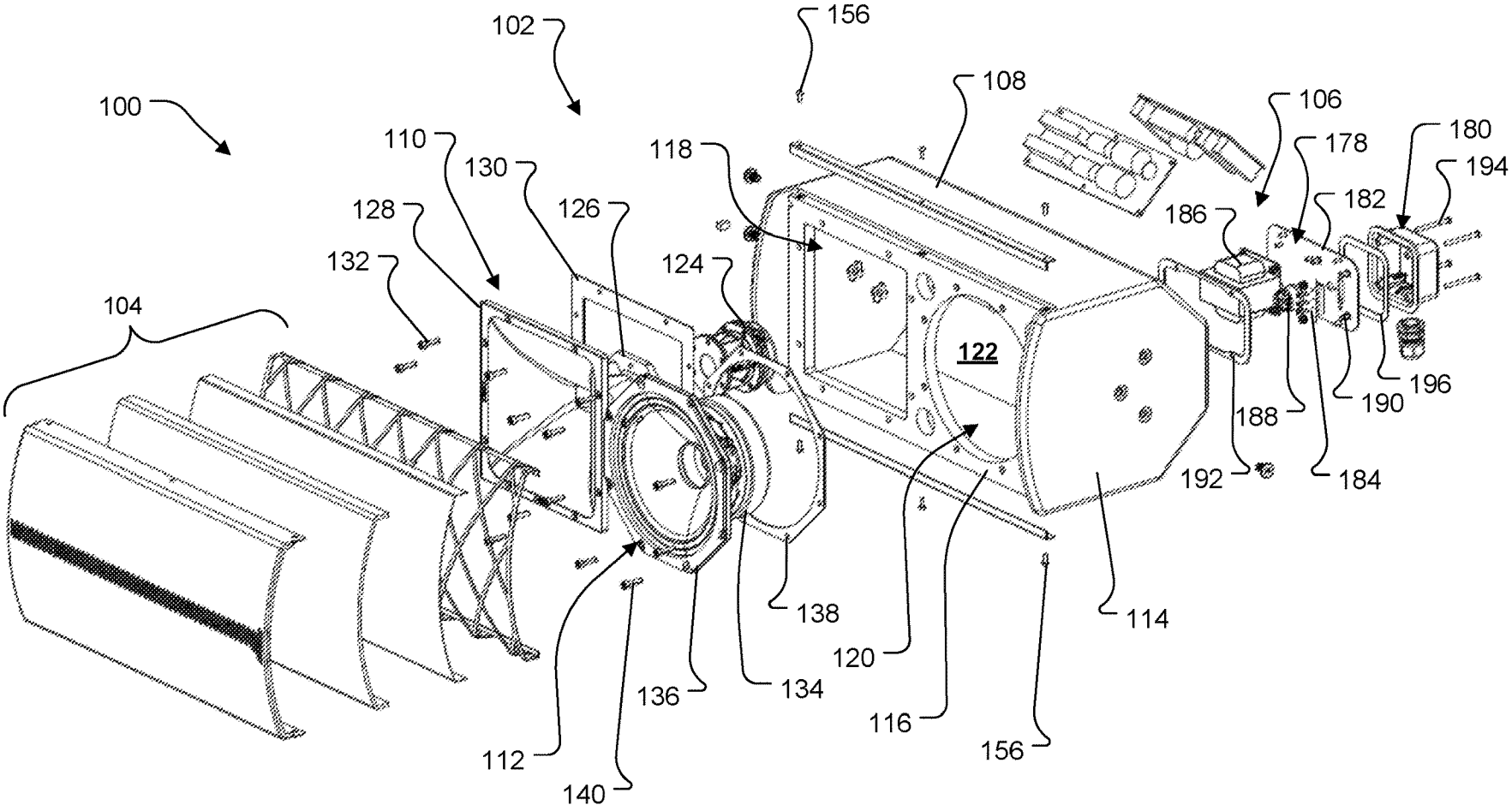
FIG. 1A is an exploded perspective view of a first implementation of a loudspeaker.

With reference to FIG. 1A, a loudspeaker 100 includes an acoustic assembly 102, a grille assembly 104, and an input/output (I/O) assembly 106. Notably the grille assembly 104 is configured to be weather-resistant, thereby to protect components of the acoustic assembly 102 from moisture to enable outdoor use of the loudspeaker 100.

Acoustic Assembly

The acoustic assembly 102 includes an acoustic enclosure 108 and a plurality of electro-acoustic transducers 110, 112, which are supported by the acoustic enclosure 108. The acoustic enclosure 108 includes a cabinet 114 and a baffle 116. The cabinet 114 and the baffle 116 may be formed of a rigid material such as metal, hard plastic, wood (e.g., plywood), or fiber board (e.g., medium-density fiberboard (MDF). The baffle 116 includes a plurality of openings 118, 120 for receiving the electro-acoustic transducers 110, 112. The cabinet 114 and the baffle 116 together define an acoustic cavity 122.

In the illustrated example, the electro-acoustic transducers 110, 112 include a high-frequency (HF) transducer 110 and a low-frequency (LF) transducer 112. The HF transducer 110 includes a compression driver 124 that is coupled a throat of a horn 126. The compression driver 124 is passed through a first opening 118 in the baffle 116 and is received within the acoustic cavity 122. A mouth of the horn 126 is secured to the baffle 116 via a frame 128 that surrounds the mouth. A gasket 130 is disposed between the frame 128 and the baffle 116 to inhibit buzz and provide an acoustic seal between the frame 128 and the acoustic cavity 122. The frame 128 is secured to the baffle 116 with fasteners 132.

An electro-magnetic motor 134 of the LF transducer 112 is passed through a second opening 120 in the baffle 116 and is received within the acoustic cavity 122. The LF transducer 112 is secured to the baffle 116 via a frame 136. A gasket 138 is disposed between the frame 136 and the baffle 116 to inhibit buzz and provide an acoustic seal between the frame 136 and the acoustic cavity 122. The frame 136 is secured to the baffle 116 with fasteners 140. The LF transducer 112 is arranged such that a rear radiating surface of the LF transducer 112 radiates acoustic energy into the acoustic cavity 122.

Grille Assembly

Figure 1B:
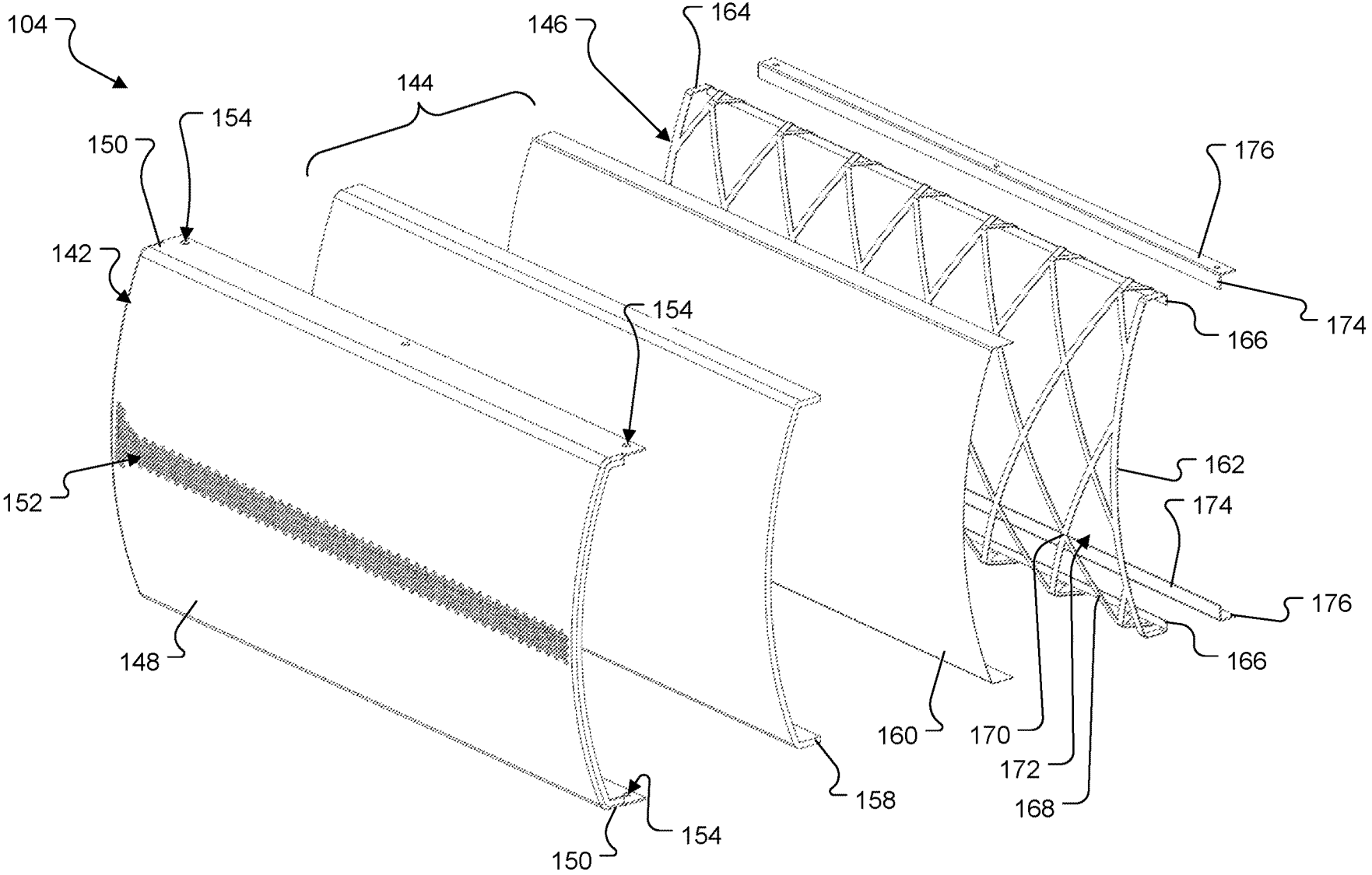
FIG. 1B is an exploded perspective view of a grille assembly from the loudspeaker of FIG. 1A.

Referring to FIG. 1B, the grille assembly 104 includes a grille 142, a weather-resistant member 144, and a spring member 146. The grille 142 has a substantially arcuate main body 148 that extends between a pair of opposing sidewalls 150. The main body 148 includes a plurality of apertures 152 that allow acoustic energy, radiated by the electro-acoustic transducers 110, 112 to pass through the grille 142. The sidewalls 150 include a plurality of mounting holes 154 for receiving fasteners 156 (FIG. 1A) for securing the grille 154 to the acoustic enclosure 108 (FIG. 1A). The grille 142 can be formed of a rigid material such as a metal (e.g., stainless steel) or hard plastic.

The weather-resistant member 144 is a sheet form material that overlies the apertures 152 along a rear surface of the grille 142. The weather-resistant member 144 is acoustically transparent and is configured to inhibit water and dust from entering. In that regard, the apertures 152 may allow water to pass through the grille 142. This is more likely when the loudspeaker 100 is mounted outdoors and is subject to the elements include, for example, driving rain. The weather-resistant member 144 is configured to inhibit (e.g., prevent) water that passes through the grille 142 from reaching the electro-acoustic transducers 110, 112. In some cases, the weather-resistant member 144 is configured to enable the loudspeaker 100 to pass IPX testing, which tests against driven water and dust). In some implementations, the loudspeaker is weather-resistant beyond a minimum IPX rating of IPX IP55.

In the illustrated example, the weather-resistant member 144 includes a scrim layer 158 and a screen layer 160. The scrim layer 158 is a first barrier against water and dust infiltration. The scrim layer 158 may be formed from a sheet form foam material, such as a polyethylene foam. One suitable material for the scrim layer 158 is 60 PPI fireproof polyethylene foam with a thickness of 2 mm to 10 mm, e.g., 4 mm thickness. The screen layer 160 is second barrier against water and dust infiltration. In some cases, the screen layer 160 may help to ensure that forces applied to rear surface of the scrim layer 158 (as described below) are more evenly distributed. The screen layer 160 is another acoustically transparent sheet form material and may be formed of a woven fabric of metal filaments (e.g., 316H stainless steel woven wire mesh).

A front surface of the scrim layer 158 rests against a rear surface of the grille 142, and a front surface of the screen layer 160 rests against a rear surface of the scrim layer 158. Prolonged exposure to the elements, such as wind and rain, might cause the weather-resistant member 144 to sag. The sagging of the weather-resistant member 144 might result in flapping, i.e., movement of the member 144 during use, which might result undesirable acoustic effects. For example, the weather-resistant member 144 could be forced against the electro-acoustic transducers and thereby affect acoustics. Sagging of the weather-resistant member 144 might also allow water to pool between the grille 142 and the weather-resistant member 144, which might ultimately contribute to failure of the weather-resistant member 144. In some instances, the weather-resistant member 144 also serves as a cosmetic backing to the grille 142, and sagging might degrade the cosmetic appearance of the loudspeaker 100.

In some cases, adhesives may be used to secure the water-resistant member 144 to the grille 142. For example, the scrim layer 158 may be secured to the grille 142 with an adhesive. Alternatively or additionally, the screen layer 160 may be secured to the scrim layer 158 with an adhesive. However, with prolonged exposure to the elements, adhesives can fail. As a result, adhesives alone might only help to delay, but not prevent, sagging of the water-resistant member 144. Adhesives might also occlude pores and openings in the water-resistant member 144, which can adversely affect the acoustic transparency of the water-resistant member 144.

The spring member 146 is configured to provide prolonged protection against sag. The spring member 146 includes a substantially arcuate main body 162 that extends between a pair of opposing sidewalls 164, which terminate at a pair of feet 166. The curvature of the main body 162 of the spring member 146 conforms generally to that of the main body 148 (FIG. 1) of the grille 142. The arcuate main body 162 includes a plurality of cross-members 168, which extend diagonally relative to the sidewalls 164. The cross-members 168 intersect with each other at nodes 170. Open regions 172 between the cross-members 168 allow for acoustic energy radiate by the electro-acoustic transducers to pass therethrough.

Preferably, the spring member 146 is designed such that the cross-members 168 and nodes 170 are spaced away from the motion axes of the electro-acoustic transducers 110, 112 (FIG. 1A), e.g., such that respective ones of the open regions 172 are centered along the motion axes of the electro-acoustic transducers 110, 112.

The cross-members 168 have a width (w) of 5 mm or less (e.g., 4 mm-5 mm). Cross-members with a width greater than 5 mm can undesirably interfere with audible frequencies produced by the electro-acoustic transducers 110, 112. The spring member 146 can be formed of metal, such as stainless steel. In one example, the spring member 146 is formed from a sheet of stainless steel that is punched to form the cross-members, and bend to shape to impart a curvature to the main body 162 and to form the sidewalls 164 and feet 166.

The main body 162 extends along a rear surface of the water-resistant member 144. the substantially arcuate main body 162 is biased outwardly, away from the acoustic enclosure 108, such that a concave side the main body 162 faces toward the acoustic enclosure 108 and an opposite, convex side faces toward the concave inner surface of the grille 142.

The feet 166 sit on the acoustic enclosure 108 (FIG. 1A) and allow for the main body 162 of the spring member 146 to apply a force to the rear surface of the water-resistant member 144. A gasket 174 (e.g., an ethylene-vinyl acetate (EVA) gasket) may be disposed between the feet 166 and the acoustic enclosure 108 to help inhibit buzz.

The grille 142 is coupled to the acoustic enclosure 108 (FIG. 1A) via fasteners 156 (FIG. 1A), thereby securing the spring member 146 between the grille 142 and the acoustic enclosure 108 and sandwiching the water-resistant member 144 between the grille 142 and the spring member 146. When assembled, the spring member 146 applies a compressive force along the rear surface of the water-resistant member 144, thereby to hold a front surface of the water-resistant member 144 in close contact with the rear surface of the grille 142. In that regard, following assembly, the spring member 146 compresses the water-resistant member 144 between 0.5 mm and 2 mm (e.g., between 10% and 25% of its uncompressed thickness).

As a result, the spring member 146 helps to ensure that the water-resistant member 144 remains in close contact with the grille 142 even after prolonged exposure to the elements, thereby reducing the likelihood of sagging and the resulting flapping, potential loss of water-resistance, and deteriorated cosmetic appearance. The inclusion of the spring member 146 can also alleviate the need for adhesives on the surfaces of the water-resistant member 144 which can occlude openings and adversely affect the acoustic transparency of the water-resistant member 144.

A gasket 176 (e.g., an ethylene-vinyl acetate (EVA) gasket) may be disposed between the grille 142 and the acoustic enclosure 108 (FIG. 1A) to inhibit buzz. In some implementations, the gasket 174 (between the spring member 146 and the acoustic enclosure 108) and the gasket 176 (between the grille 142 and the acoustic enclosure 108) may be formed from one piece of material. For example, a single strip of gasket material may be folded along its length to provide a first gasket portion to sit between the spring member 146 and the acoustic enclosure 108, and a second gasket portion to sit between the grille 142 and the acoustic enclosure 108.

I/O Assembly

Referring again to FIG. 1, the I/O assembly 106 is mounted to a rear surface of the acoustic enclosure 108 for coupling electrical wires (not shown) to power the electro-acoustic transducers 110, 112. The I/O assembly 106 includes an I/O panel 178 and an I/O cover 180. The I/O panel 178 includes a mounting plate 182 that supports a terminal strip 184, a transformer 186, and a selector switch 188. The terminal strip 184 allows electrical wires to be connected to the loudspeaker 100 to power the electro-acoustic transducers 110, 112 (i.e., via an opening, not shown, in a rear surface the acoustic enclosure 108). The selector switch 188 can be a rotary switch from selecting among the multiple taps of the transformer 186.

The mounting plate 182 is secured to the acoustic enclosure 108 via fasteners 190. A gasket 192 (e.g., an ethylene-vinyl acetate (EVA) gasket) is disposed between the mounting plate 182 and the acoustic enclosure 108 to provide a water-resistant seal. The gasket 192 can also help to provide an acoustic seal (e.g., to inhibit leakage of acoustic energy from the acoustic enclosure 108), and inhibit buzz (e.g., between the acoustic enclosure 108 and the mounting plate 182).

The I/O cover 180 provides water-resistant protection for the terminal strip 184 and may formed as a molded plastic part. The I/O cover 180 is secured to the mounting plate 182 with fasteners 194. A gasket 196 (e.g., an ethylene-vinyl acetate (EVA) gasket) provides a water-resistant seal between the I/O cover 180 and the mounting plate 182 and can also help to inhibit buzz therebetween.

Other Implementations

Figure 2A:
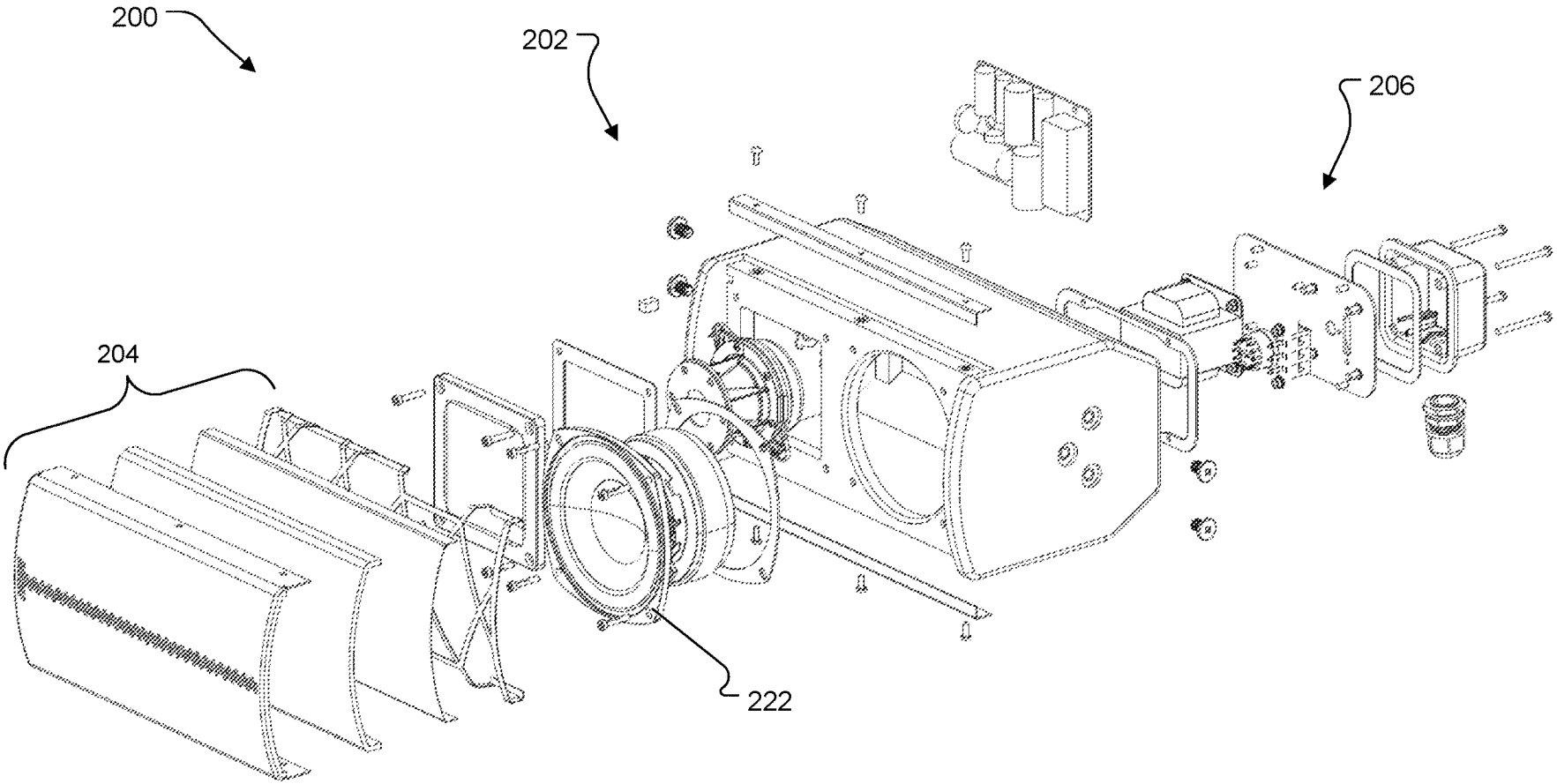
FIG. 2A is an exploded perspective view of a second implementation of a loudspeaker.
Figure 2B:
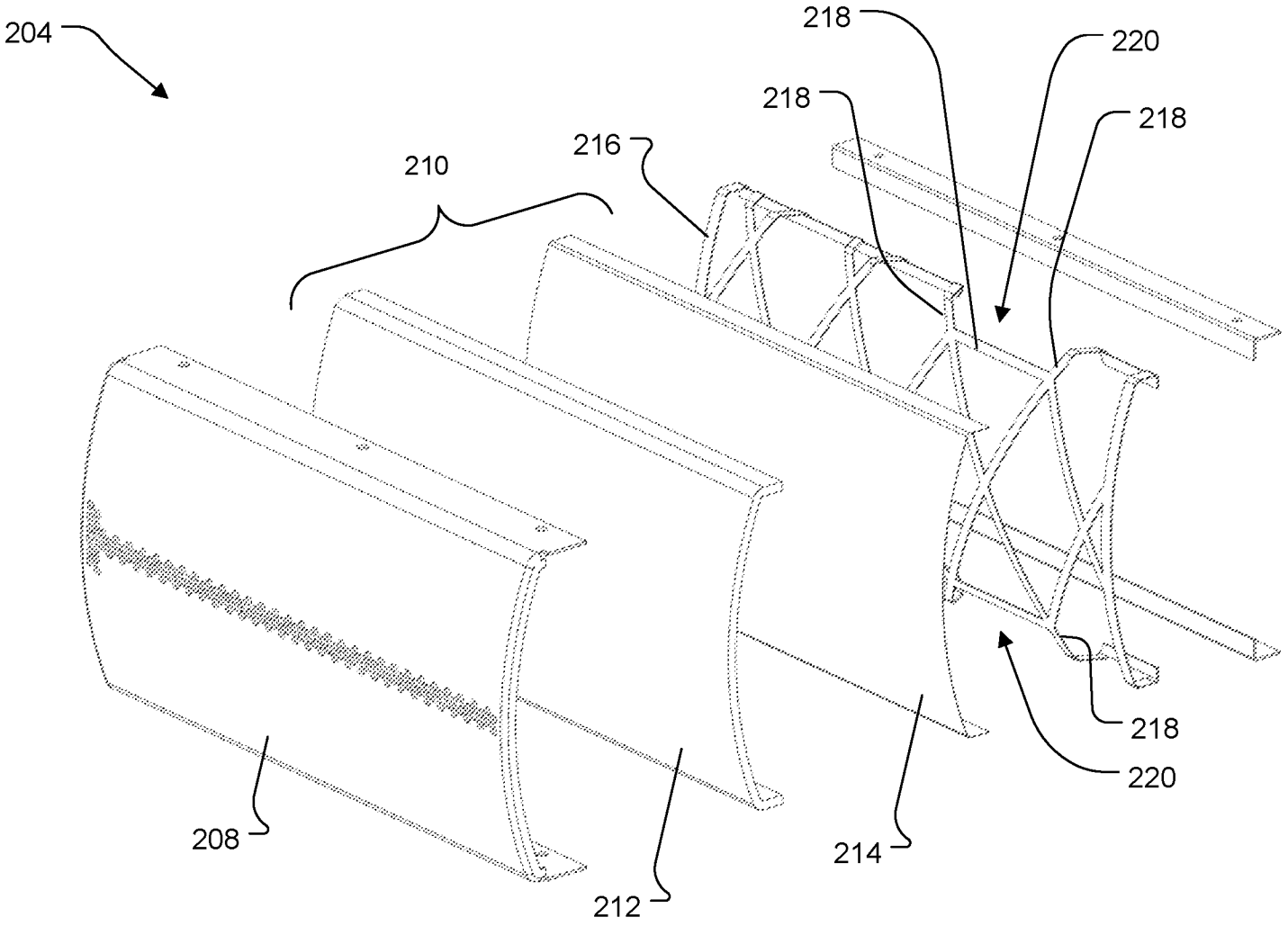
FIG. 2B is an exploded perspective view of a grille assembly from the loudspeaker of FIG. 2A.

While one or more implementations of a loudspeaker have been described above, other implementations are possible. For example, FIG. 2A illustrates another loudspeaker 200. The loudspeaker 200 includes an acoustic assembly 202, a grille assembly 204, and an I/O assembly 206. The grille assembly 204 may have a similar construction to the one described above with respect to FIG. 1B. As shown in FIG. 2B, the grille assembly 204 may include a grille 208, a water-resistant member 210 including a scrim layer 212 and a screen layer 214, and a spring member 216. However, in the implementation illustrated in FIGS. 2A & 2B, cross-members 218 of the spring member 216 define a notch 220. The notch 220 is configured to accommodate the geometry of an electro-acoustic transducer 222 (FIG. 2A); i.e., to prevent the spring member 216 from interfering with the electro-acoustic transducer 222.

In some implementations, the weather-resistant member may consist of a scrim layer without a screen backing layer. Alternatively, the weather-resistant member may consist of a screen layer without a scrim layer. In some cases, the loudspeaker may include a cosmetic material as an alternative to or in addition to the weather-resistant member.

While an implementation has been described in which the spring member is formed of stamped and formed sheet metal, an alternative spring member could be formed of wire mesh (e.g., "chicken wire") that is bend to shape.

In some implementations, the cross-members could extend between sidewalls and substantially perpendicular thereto.

While an implementation has been described in which the spring member has substantially arcuate main body that is biased outwardly, away from the acoustic enclosure, in other implementations the main body of the spring member can be flat or inwardly curved, e.g., to work which flat or inwardly curved grille.

A number of implementations have been described. Nevertheless, it will be understood that additional modifications may be made without departing from the scope of the inventive concepts described herein, and, accordingly, other implementations are within the scope of the following claims.

What is claimed is:

1. A loudspeaker comprising: an acoustic enclosure;

an electro-acoustic transducer supported by the acoustic enclosure; a grille covering the electro-acoustic transducer;

a weather-resistant member disposed between the acoustic enclosure and the grille; and a spring member disposed between the weather-resistant member and the acoustic enclosure, wherein the spring member is configured to apply a force to the weather-resistant member thereby to hold the weather-resistant member against the grille, wherein the spring member comprises an arcuate main body that extends between a pair of opposing sidewalls.

2. The loudspeaker of claim 1, wherein the weather-resistant member comprises a scrim layer.

3. The loudspeaker of claim 2, wherein the scrim layer is formed of an acoustically transparent sheet form foam material.

4. The loudspeaker of claim 1, wherein the arcuate main body is biased outwardly, away from the acoustic enclosure, such that a concave side of the main body faces toward the acoustic enclosure.

5. The loudspeaker of claim 4, wherein the arcuate main body comprises a plurality of cross-members.

6. The loudspeaker of claim 5, wherein the cross-members extend diagonally relative to the sidewalls.

7. The loudspeaker of claim 5, wherein the cross-members intersect with each other at nodes.

8. The loudspeaker of claim 5, wherein the cross-members are arranged to form a notch to accommodate the geometry of the electro-acoustic transducer.

9. The loudspeaker of claim 2, wherein the weather-resistant member further comprises a screen layer disposed between the spring member and the scrim layer, wherein the spring member is configured to apply a force to the screen layer to hold a front surface of the screen layer against a rear surface of the scrim layer and to hold a front surface of the scrim layer against a rear surface of the grille.

10. The loudspeaker of claim 9, wherein the screen layer comprises an acoustically transparent sheet form material formed of a woven fabric of metal filaments.

11. The loudspeaker of claim 1, wherein the weather-resistant member comprises a screen layer.

12. The loudspeaker of claim 11, wherein the screen layer comprises an acoustically transparent sheet form material formed of a woven fabric of metal filaments.

13. A grille assembly for a loudspeaker, the grille assembly comprising:

a grille;

a spring member; and a weather-resistant member disposed between the spring member and the grille, wherein the spring member is configured to apply a force between an acoustic enclosure of a loudspeaker and the weather-resistant member to hold a front surface of the weather-resistant member substantially flush against a rear surface of the grille, wherein the spring member comprises an arcuate main body that extends between a pair of opposing sidewalls.

14. The grille assembly of claim 13, wherein the weather-resistant member comprises a scrim layer.

15. The grille assembly of claim 14, wherein the scrim layer is formed of an acoustically transparent sheet form foam material.

16. The grille assembly of claim 13, wherein the sidewalls terminate at a pair of feet, which are arranged to rest against a surface of the acoustic enclosure of the loudspeaker.

17. The loudspeaker of claim 13, wherein the arcuate main body is biased outwardly, away from the acoustic enclosure, such that a concave side of the main body faces toward the acoustic enclosure.

18. The grille assembly of claim 13, wherein the arcuate main body comprises a plurality of cross-members.

19. The grille assembly of claim 18, wherein the cross-members extend diagonally relative to the sidewalls.

20. The grille assembly of claim 18, wherein the cross-members intersect with each other at nodes.

21. The grille assembly of claim 18, wherein the cross-members are arranged to form a notch to accommodate the geometry of an electro-acoustic transducer of the loudspeaker.

22. The grille assembly of claim 14, wherein the weather-resistant member further comprises a screen layer disposed between the spring member and the scrim layer, wherein the spring member is configured to apply a force to the screen layer to hold a front surface of the screen layer against a rear surface of the scrim layer and to hold a front surface of the scrim layer against a rear surface of the grille.

23. The grille assembly of claim 22, wherein the screen layer comprises an acoustically transparent sheet form material formed of a woven fabric of metal filaments.

24. The grille assembly of claim 13, wherein the weather-resistant member comprises a screen layer.

25. The grille assembly of claim 24, wherein the screen layer comprises an acoustically transparent sheet form material formed of a woven fabric of metal filaments.

* * * * *